United States Patent [19]

Bos et al.

[11] Patent Number: 4,893,476

[45] Date of Patent: Jan. 16, 1990

[54] THREE FUNCTION HEAT PUMP SYSTEM WITH ONE WAY RECEIVER

[75] Inventors: Willem Bos, Sacramento; Martin Fanciullo, Rancho Cordova, both of Calif.

[73] Assignee: Phenix Heat Pump Systems, Inc., Sacramento, Calif.

[21] Appl. No.: 231,454

[22] Filed: Aug. 12, 1988

[51] Int. Cl.[4] ..... F25B 7/00

[52] U.S. Cl. ..... 62/79; 62/238.6; 62/238.7

[58] Field of Search ..... 62/238.6, 238.7, 324.1, 62/324.7, 509, 79; 237/2 B; 165/29

[56] References Cited

U.S. PATENT DOCUMENTS

| | | | |
|---|---|---|---|
| 4,055,963 | 11/1977 | Shoji et al. | 62/238.6 |
| 4,199,955 | 4/1980 | Jonsson | 62/238.6 X |
| 4,209,996 | 7/1980 | Shaw | 62/238.6 X |
| 4,380,156 | 4/1983 | Ecker | 62/238.7 X |
| 4,645,908 | 2/1987 | Jones | 219/378 |
| 4,655,051 | 4/1987 | Jones | 62/324.4 |
| 4,685,307 | 8/1987 | Jones | 62/160 |
| 4,693,089 | 9/1987 | Bourne et al. | 62/79 |
| 4,751,823 | 6/1988 | Hans | 62/238.6 X |

*Primary Examiner*—Lloyd L. King

*Attorney, Agent, or Firm*—Arnold, White & Durkee

[57] ABSTRACT

The invention relates to a three function heat pump system which provides space heating, space cooling and hot water production. The system permits hot water production all year long without operation of the system in the heating or cooling modes. The system also provides a check valve arrangement which allows passage of a refrigerant through the receiver in all three modes without reversing the flow of the refrigerant through the receiver. The valving arrangement also prevents migration of the refrigerant from the liquid receiver to a thermal storage tank during the hot water production mode. In addition, the valve arrangement allows the refrigerant to pass through throttle or expansion valves when the liquid is passing from the liquid receiver to the thermal storage tank and outdoor air coil, while bypassing the expansion valves when the refrigerant passes from the outdoor air coil and the thermal storage tank to the liquid receiver inlet.

14 Claims, 1 Drawing Sheet

THREE FUNCTION HEAT PUMP SYSTEM WITH ONE WAY RECEIVER

BACKGROUND AND SUMMARY OF THE INVENTION

The invention relates to a three function heat pump system with a reversible flow refrigerant. More particularly, the invention relates to a three function heat pump system for space heating, cooling and water heating with a receiver which permits refrigerant through-flow in only one direction even though the flow of refrigerant is reversible in the system for heating and cooling.

Three function heat pumps systems are known in which a flow of refrigerant is reversed to obtain heating in winter months, cooling in summer months, and hot water for domestic use. See, for example, U.S. Pat. Nos. 4,693,089; 4,655,051; 4,654,908; and 4,685,307. If a space conditioning tank contains ice, or if the space conditioning tank has a volume which exceeds that of an outdoor heat exchanger, then more refrigerant may be necessary for the heating mode than the cooling mode. Such systems may employ a receiver for surplus refrigerant such that the receiver stores or accumulates excess refrigerant in the cooling mode (summer), and supplies additional refrigerant for the heating mode (winter).

Since the known three function heat pumps reverse the flow of refrigerant, the flow through the receiver is also reversible. This complicates the system since safeguards must be provided to insure proper flow through the receiver and prevent the migration of refrigerant from the receiver to other system components. For example, if the space conditioning tank contains ice, and the system is deactivated, the refrigerant has a tendency to migrate toward the space conditioning tank. Safeguards may be necessary to prevent such migration from the reversible inlets and outlets of the receiver, thereby complicating and increasing the cost of the system.

Accordingly, it is an object of the invention to provide a three function heat pump system which includes a one-way receiver to simplify the system by preventing migration.

It is a further object of the invention to provide a three function heat pump system in which the refrigerant flow in a portion of the system is reversed when switching among the various modes, without reversing flow through the receiver.

It is a further object of the invention to provide a check valve arrangement about the receiver to allow for reversing of the refrigerant flow while utilizing a unidirectional liquid receiver.

It is a further object of the invention to provide a three function heat pump arrangement in which the refrigerant is throttled by a thermal expansion valve when the flow is in one direction, while the expansion valve is by-passed when the flow is in an opposite direction.

These and other objects, advantages and features are provided by the three function heat pump system in accordance with the invention. The system includes a compressor for compressing the refrigerant into a high pressure, high temperature refrigerant. The refrigerant flows within a reversible flow conduit which provides communication among a first heat exchanger or thermal storage tank which provides for space heating; a second heat exchanger for heating domestic hot water; and a third external heat exchanger in the form of an outdoor air-coil.

The system includes a liquid receiver located between the first or second heat exchanger and the third heat exchanger in the heating mode, and between the second heat exchanger and the first heat exchanger in the cooling or hot water production mode. The receiver is surrounded by four check valves which allow for unidirectional flow through the receiver. The location of the receiver and its check-valve arrangement permits the receiver to store excess refrigerant or supply refrigerant to the system as needed in the various modes of operation. The arrangement prevents migration of refrigerant from the receiver to the thermal storage tank. The check valve arrangement also allows for the flow to pass through expansion valves when the refrigerant flows in a first direction, while by-passing the expansion valves when flow is in the second opposite direction.

The system also provides hot water production irrespective of the heating and cooling modes by providing a three-way valve downstream of the hot water heat exchanger to bypass the first heat exchanger. Accordingly, hot water is produced regardless of the heating and cooling modes by directing the refrigerant flow through the external heat exchanger.

BRIEF DESCRIPTION OF THE DRAWING

The invention will be described in detail hereinafter with reference to the following drawing which is a schematic diagram of the three function heat pump system of the present invention.

DETAILED DESCRIPTION OF THE PREFERRED EMBODIMENT

Figure 1:
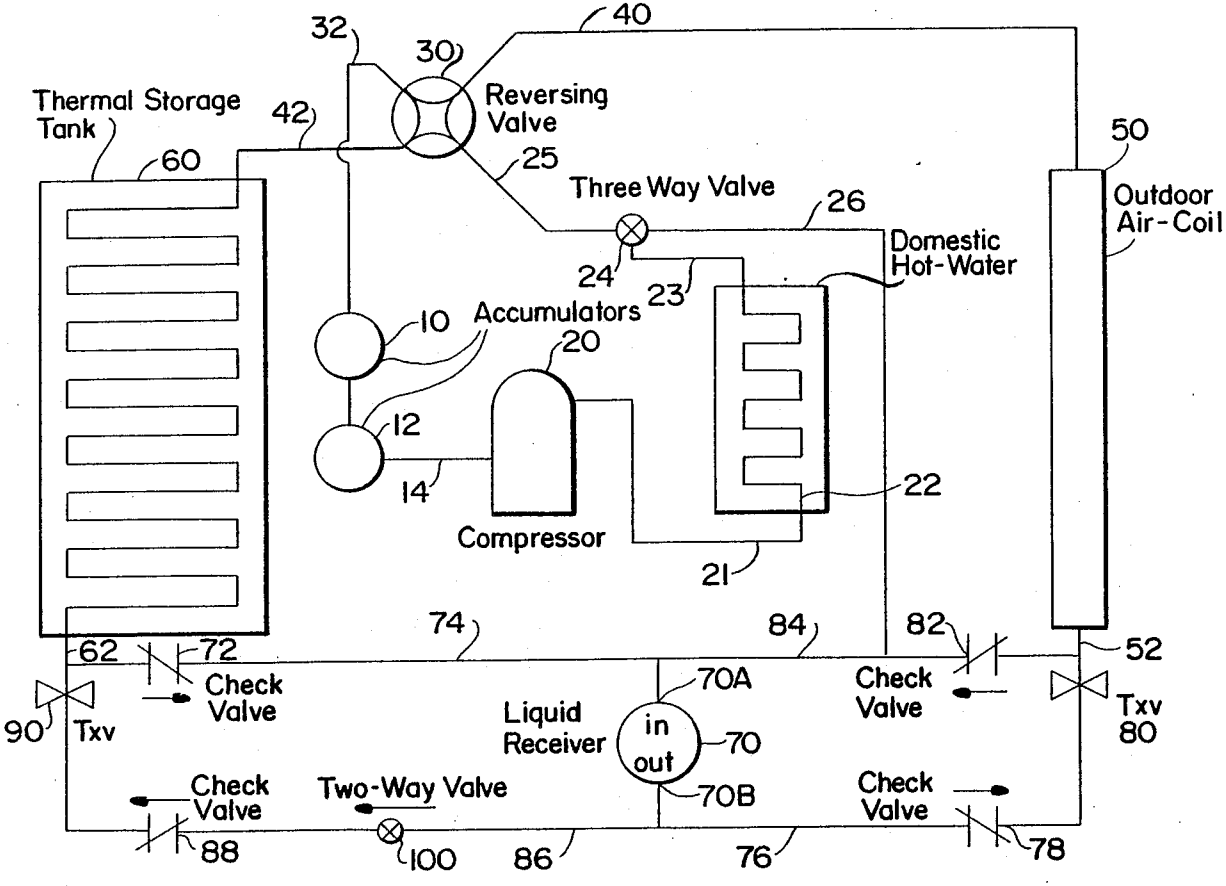

The three function heat pump concept employs reversible heat pump technology to provide space heating, space cooling and year-long hot water heating from a single system. Except for the receiver, the operation of the three function heat pump system of the present invention is similar to that of U.S. Pat. No. 4,693,089, the disclosure of which is herein incorporated by reference. Further, the three function heat pump system described herein is designed primarily for residential applications. However, those skilled in the art may adapt the system for other applications without departing from the spirit and scope of the invention as defined in the appended claims.

In summary, the heat pump system of the present invention includes a relatively large first heat exchanger in the form of a thermal storage tank for space conditioning (hereinafter "thermal storage tank"), a second heat exchanger for domestic water heating (hereinafter "domestic hot water tank") and a third external heat exchanger (hereinafter "outdoor heat exchanger"). Energy is stored within the thermal storage tank and can be withdrawn when needed without requiring immediate compressor operation. The compressor is then operated to store energy within the thermal storage tank to the greatest extent possible, the compressor being operated at times when operation of the compressor is less expensive (i.e., off peak times), or more efficient (i.e., favorable weather). During winter, the compressor operates to add heat to the thermal storage tank for space heating. Under normal conditions, hot gas from the compressor also will deliver heat to the domestic water tank and then to the space conditioning tank (thermal storage tank). During summer, the refrigerant flow direction is reversed. Heat is extracted from the thermal storage tank to produce therein either chilled water or ice, and is rejected to the outdoor heat exchanger.

The winter and summer operating modes allow domestic water to be heated by the heat pump when there are no space heating or cooling loads. In addition, with appropriate controls, the compressor may be programmed to operate when the weather and utility rates are most favorable. The system stores heating or cooling energy for use on demand.

It is noted that space heating and cooling are accomplished by pumping hot or cold water from the thermal storage tank to a distribution system within the building or internal environment. The heat distribution system may include a heat exchange coil, a blower, a duct system to circulate the heated or cooled air, or other available hydronic heating/cooling components. The components of the heat pump system are preferably provided in a compact unit, thereby minimizing the connections between the unit and the heat distribution system, as well as facilitating rapid installation in the field.

With reference to the schematic of the three function heat pump system of the attached FIG. 1, the system includes a compressor 20 which may be driven by any means, but preferably by an electric motor. The compressor 20 operates on a refrigerant capable of changing its phase between liquid and gaseous states. Several commercially available refrigerants are suitable, but Freon 22 is the preferred refrigerant. The compressor includes an inlet line 14 through which low pressure gas is introduced into the compressor, and an outlet line 21 through which super-heated high pressure gas exits from the compressor 20.

The hot gas in the outlet line 21 is directed towards a domestic water heat exchanger 22 to heat the water therein for domestic use. The heat exchanger 22 may be located either in an insulated domestic water tank or nearby the tank with tank water pumped through the heat exchanger 22 to heat water from the hot refrigerant gas. The tank for the water heated by heat exchanger 22 is preferably insulated and conventionally includes a cold water input line (not shown) and a hot water exit line (not shown) which directs heated water toward the building for use.

A three way valve 24 is provided at the end of the domestic hot-water tank outlet line 23. When the system is in the heating or cooling mode the refrigerant flows from the outlet line 23 through the three way valve 24 to inlet line 25. During the hot water production mode (i.e., operation without the heating or cooling modes), the three way valve 24 directs the refrigerant from outlet line 23 to conduit line 26 as discussed below in detail. For heating and cooling, the outlet line 25 is in connection with a reversing valve 30 which allows for the reversing of the refrigerant flow for the heating and cooling modes. In the heating mode, the refrigerant is directed from the outlet 25 to the conduit 42 to direct the refrigerant through a heat exchanger in a thermal storage tank 60. In the cooling mode, refrigerant is directed from the outlet 25 to conduit 40 to direct refrigerant to an outdoor heat exchanger or air coil 50.

The reversing valve 30 directs the flow through the system for operation in the heating and cooling mode with hot water production. In the heating mode, the hot gas refrigerant proceeds through the thermal storage tank 60 which acts as a system condenser for the heating mode. In the tank 60, the gas fully condenses to a liquid thus heating the medium, usually water, within the thermal storage tank. The refrigerant then passes to the reversible flow conduit 62 and through the check valve 72 for introduction through receiver 70 via inlet line 74. The refrigerant passes through the receiver 70, outlet line 76, check valve 78, throttle or expansion valve 80, and reversible flow conduit 52 to the outdoor air-coil 50, as discussed in detail below. The outdoor air-coil 50 functions as a system evaporator in the heating mode for extracting heat from the outdoor environment. The heated refrigerant is directed back to the reversing valve 30 through the conduit 40. The reversing valve 30 directs the flow through an exit line 32 to accumulators 10, 12 for return to the compressor 20.

In the cooling mode, the flow is reversed so that the hot gas proceeds from the reversing valve 30 to the outdoor air coil 50 through the conduit 40. The hot gas condenses in the heat exchanger 50 to give up heat. The cooled gas then proceeds through the reversible flow conduit 52 and check valve 82 for introduction through the receiver 70 via inlet line 84. The refrigerant then passes through the receiver 70, outlet line 86, a two-way valve 100 (which is energized to be open in the cooling mode), check valve 88, throttle or expansion valve 90 and reversible flow conduit 62 to the thermal storage tank 60, as discussed below in detail. From the thermal storage tank 60, the refrigerant passes through the conduit 42 to the reversing valve 30 which directs the flow through the exit line 32 and accumulators 10, 12 for return to the compressor 20.

The receiver 70 is located in the reversible flow conduit system between the thermal storage tank 60 and outdoor aircoil 50 for storing the refrigerant. The receiver 70 stores and provides refrigerant to meet various refrigerant demands according to different operating conditions. Since the system condenser will typically contain more refrigerant than the evaporator, the system with ice-making cooling operation requires more refrigerant in winter for heating than in summer for cooling because of the large refrigerant capacity of the heat exchanger in the tank 60. The receiver 70 will accumulate excess refrigerant in the summer, and supply additional refrigerant in the winter.

The receiver 70 includes an inlet 70A connected to inlet lines 74, 84 and an outlet 70B connected to outlet lines 76, 86. The flow through the receiver always enters the receiver 70 through the inlet 70A and always exits the receiver 70 through the outlet 70B. Each inlet and outlet line 74, 84; 76, 86, includes a check valve 72, 82; 78, 88 to insure correct flow into and out of the receiver. For example, the inlet check valves 72, 82 prevent back flow of refrigerant away from the receiver 70 in the inlet lines 74, 84; and the outlet check valves 78, 88 prevent back flow of refrigerant toward the receiver 70 in the outline lines 76, 86. Each outlet line 76, 86 also includes a throttle or expansion valve 80, 90 for introducing refrigerant into the thermal storage tank 60 (for cooling) or outdoor air coil 50 (for heating).

The conduit line 26 from the three way valve 24 communicates with the inlet line 84 preferably downstream of the inlet check valve 82. For hot water production without heating or cooling, the three way valve 24 directs refrigerant into the conduit line 26 for flow toward the inlet 70A of the receiver 70 via the inlet line 84. Check valves 72, 82; 78, 88 are provided to ensure correct flow into and out of the receiver. The two-way valve 100 is provided in outlet line 86 to prevent flow of the refrigerant to the thermal storage tank 60 when the system is in the domestic hot water only mode.

The expansion valve 90 is provided to throttle the refrigerant to the inlet of the thermal storage tank 60 in the cooling mode while the expansion valve 80 is provided to throttle the refrigerant to the air coil 50 in the heating mode. The check valve arrangement 72, 82, 78, 88 permits the refrigerant to by-pass the throttle valve 90 when the refrigerant is exiting the thermal storage tank 60 in the heating mode. The check valve arrangement also allows the refrigerant to by-pass the expansion valve 80 when the refrigerant exits the air coil 50 in the cooling mode. The check valves, two way valve, and one-way receiver prevent migration of the refrigerant (and the resulting energy loss) from the receiver 70 to the thermal storage tank 60 when the system is deactivated or in the domestic hot water only mode. Further, the check valves and one-way receiver simplify flow in the system by ensuring unidirectional flow through the receiver even though flow reverses in the remainder of the system.

The various operating modes for the preferred embodiment are described in detail as follows:

I. HEATING MODE

In the heating mode the refrigerant is directed from inlet conduit 25 through reversing valve 30 into conduit 42. The refrigerant is directed to the thermal storage tank 60, and after transferring its heat to the medium within the tank, the refrigerant exits through line 62 and passes through inlet check valve 72. The one way check valve 72 requires the refrigerant to enter the receiver through the inlet 70A and prevents flow of the refrigerant exiting the thermal storage tank in the heating mode from passing through the expansion valve 90.

The refrigerant passes through the inlet line 74 into the receiver 70 then to outlet line 76 and through one way check valve 78. The two-way valve 100 is closed to prevent flow of refrigerant toward the expansion valve 90. Upon entering the expansion valve 80, the refrigerant is throttled to reduce its pressure before entering the outdoor air-coil 50.

The pressure drop caused by the throttle valve 80 results in a substantial drop in the temperature, thereby creating a relatively cooler liquid refrigerant, which is directed into an outdoor heat exchanger (air-coil 50). The outdoor aircoil 50 functions as an evaporator in the heating mode and may be a fan coil in which a fan pushes outdoor air through an array of thin passages or tubing to extract heat from the outdoor air. The outdoor air-coil 50 may alternatively be one or more large thin plates designed to capture solar energy for the evaporating refrigerant. Moreover, the outdoor heat exchanger may combine a thin coil with a plate.

In the outdoor air coil 50, the cold liquid expands and vaporizes as it absorbs heat from the outdoor environment while flowing through the coils. A moderate temperature gas leaves the outdoor air coil through conduit 40 for return to the reversing valve 30. The reversing valve directs the refrigerant from conduit 40 to exit line 32 for passage through accumulators 10, 12 for recycling by compressor 20.

It is noted that initially gas from the compressor 20 passes through conduit 21 to the domestic hot water heat exchanger 22. After leaving the domestic water heat exchanger 22, the water is heated and the refrigerant is typically saturated. The refrigerant is typically condensed upon exiting the thermal storage tank 60.

II. COOLING MODE

In the cooling mode, the refrigerant flow from the conduit 25 is directed through reversing valve 30 to conduit 40. The hot refrigerant condenses in the outdoor air coil 50 and passes through conduit 52 and one way check valve 82 to the liquid receiver 70 thus bypassing the expansion valve 80. The refrigerant proceeds through the receiver 70 (where it may accumulate depending on system conditions), outlet line 86, two way valve 100 and one way check valve 88. The liquid refrigerant then passes through the throttle or expansion valve 90 before entering the thermal storage tank 60. The low pressure liquid expands and evaporates in the thermal storage tank 60 to cool the medium in the tank before exiting through the outlet 42. The evaporating refrigerant may either chill the medium or freeze it, or both, depending on the system design. After leaving the storage tank 60, the superheated gas returns to enter the reversing valve 30 which directs the refrigerant to exit line 32, through accumulators 10 and 12 for recycling by the compressor 20. In this mode the outdoor thermal storage tank 60 acts as the evaporator, and the outdoor coil 50 acts as a condenser.

Like the heating mode, the refrigerant from the compressor 20 initially passes through the domestic hot water heat exchanger 22 to heat the water in the tank.

III. DOMESTIC HOT WATER HEATING

When domestic hot water heating is required without space heating or cooling, the three way valve 24 is set to direct the refrigerant from conduit 23 to conduit 26. The flow is directed to inlet line 84 into the receiver 70. The refrigerant from the receiver then passes to outlet line 76, past the check valve 78 and through expansion valve 80. The outdoor air coil 50 is used as an evaporator and the refrigerant proceeds through conduit 40 to reversing valve 30 to exit line 32. Typically, the domestic hot water heat exchanger is large enough to function as a condenser in this mode.

In the domestic hot water only mode, the two way valve 100 is deactivated and prevents flow of the refrigerant through the outlet line 86, thereby preventing migration of the refrigerant to the thermal storage tank 60 when heating or cooling is not necessary.

The principles, preferred embodiment and modes of operation of the present invention have been described in the foregoing specification. The invention which is intended to be protected herein, however, is not to be construed as limited to the particular forms disclosed, since these are to be regarded as illustrative rather than restrictive. Although the three function heat pump of the present invention has been described in connection with a preferred embodiment thereof, it will be appreciated by those skilled in the art that additions, modifications, substitutions and deletions not specifically described may be made without departing from the spirit and scope of the invention defined in the appended claims.

We claim

1. A three function heat pump system for providing a heating mode, a cooling mode, and a hot water production mode irrespective of said heating and cooling modes, comprising:

compressor means for compressing a refrigerant;

reversible flow conduit means for providing series refrigerant communication among a first heat exchanger, a domestic hot water heat exchanger, a third heat exchanger and said compressor, said reversible flow conduit means first sequentially providing series refrigerant communication among said compressor and said domestic hot water heat exchanger; and a liquid receiver communicating with said conduit means and having a one-way inlet and one-way outlet through which said refrigerant respectively enters and exits said receiver, said receiver being located downstream of said first and domestic hot water heat exchangers and upstream of said third heat exchanger in the heating and hot water production modes, and being located down-stream of said domestic hot water and third heat exchangers and upstream of said first heat exchanger in the cooling mode, said inlet receiving refrigerant from said first heat exchanger in said heating mode, said inlet receiving refrigerant from said domestic hot water heat exchanger in said hot water production mode and said inlet receiving refrigerant from said third heat exchanger in said cooling mode.

2. The heat pump system of claim 1, wherein:

said first heat exchanger heats a medium within a thermal storage tank in said heating mode and cools said medium in said thermal storage tank in said cooling mode; and said third heat exchanger cools outdoor air in said heating mode and heats outdoor air in said cooling mode.

3. The heat pump system of claim 1, further comprising three-way valve means in said reversible flow conduit means to bypass the first heat exchanger in said hot water production mode.

4. The heat pump system of claim 1, further comprising a first pair of one-way inlet check valves in said reversible flow conduit means, a one-way inlet check valve being located between each of the first and third heat exchangers and the receiver inlet.

5. The heat pump system of claim 4, further comprising a second pair of one-way outlet check valves in said reversible flow conduit means, a one-way outlet check valve being located between each of the first and third heat exchangers and the receiver outlet.

6. The heat pump system of claim 5, further comprising first and second expansion valves with an expansion valve located between each of said second pair of one-way outlet check valves and each of said first and third heat exchangers;

said outlet check valves directing flow from said receiver outlet through said first expansion valve before entering the first heat exchanger in said cooling mode, and bypassing said first expansion valve when refrigerant flows from said first heat exchanger to said receiver inlet in said heating mode;

said outlet check valves further directing refrigerant from said liquid receiver outlet through said second expansion valve to said third heat exchanger in said heating and hot water production modes, and bypassing said second expansion valve when said refrigerant flows from said third heat exchanger to said liquid receiver inlet in said cooling mode.

7. The heat pump system of claim 3 further including a two-way valve means in said reversible flow conduit means downstream of said receiver outlet for preventing flow from the receiver outlet to said first heat exchanger during said hot water production mode.

8. The heat pump system of claim 3, further including reversing valve means in said reversible flow conduit means for selectively directing refrigerant from said three-way valve toward said third heat exchanger in said cooling mode and toward said first heat exchanger in said heating mode.

9. The heat pump system of claim 6, further including reversing valve means in said reversible flow conduit means for selectively directing refrigerant from said first heat exchanger toward said compressor in said cooling mode and from said third heat exchanger toward said compressor in said heating mode and said hot water production mode.

10. A method of providing space heating, space cooling and domestic hot water in a reversible heat pump system with a one-way receiving having an inlet and an outlet, said system comprising the steps of:

directing compressed refrigerant serially through a domestic hot water heat exchanger to heat water in a domestic water tank;

selecting one of a space heating and space cooling mode; said space heating mode directing refrigerant serially from said domestic hot water heat exchanger through a thermal storage heat exchanger in a thermal storage tank to condense said refrigerant, said receiver inlet, said receiver outlet, and an external heat exchanger; said space cooling mode directing refrigerant serially from said domestic hot water heat exchanger through said external heat exchanger to condense said refrigerant, said receiver inlet, said receiver outlet, and said thermal storage heat exchanger; and preventing introduction of refrigerant into said receiver outlet from said thermal storage heat exchanger in said heating mode and from said external heat exchanger in said cooling mode. said receiver outlet, and said thermal storage heat exchanger; and

11. The method of claim 10 further comprising the steps of:

selecting a hot water production mode without space heating or space cooling; said hot water production mode serially directing refrigerant through said hot water heat exchanger, said receiver inlet, said receiver outlet, and said external heat exchanger; and preventing introduction of refrigerant into said receiver outlet from said thermal storage heat exchanger and external heat exchanger in said hot water production mode.

12. The method of claim 11 further comprising the step of preventing flow from said receiver outlet to said thermal storage tank in said hot water production mode.

13. A three function heat pump system for providing a heating mode, a cooling mode, and a hot water production mode irrespective of said heating and cooling modes, comprising:

compressor means for compressing a refrigerant;

reversible flow conduit means for providing series refrigerant communication among a first heat exchanger, a domestic hot water heat exchanger, a third heat exchanger and said compressor, said reversible flow conduit means first sequentially providing series refrigerant communication among said compressor and said domestic hot water heat exchanger;

a liquid receiver communicating with said conduit means and having a one-way inlet and one-way outlet through which said refrigerant respectively enters and exits said receiver, said receiver being located downstream of said first and domestic hot water heat exchangers and upstream of said third heat exchanger in the heating and hot water production modes, and being located down-stream of said domestic hot water and third heat exchangers and upstream of said first heat exchanger in the cooling mode, said inlet receiving refrigerant from said first heat exchanger in said heating mode, said inlet receiving refrigerant from said domestic hot water heat exchanger in said hot water production mode and said inlet receiving refrigerant from said third heat exchanger in said cooling mode;

a first pair of one-way inlet check valves in said reversible flow conduit means, a one-way inlet check valve being located between each of the first and third heat exchangers and the receiver inlet; and a second pair of one-way outlet check valves in said reversible flow conduit means, a one-way outlet check valve being located between each of the first and third heat exchangers and the receiver outlet.

14. The heat pump system of claim 13, further comprising three-way valve means in said reversible flow conduit means to bypass the first heat exchanger in said hot water production mode, and a two-way valve means in said reversible flow conduit means downstream of said receiver outlet for preventing flow from the receiver outlet to said first heat exchanger during said hot water production mode.

* * * * *